US011002031B2

(12) United States Patent
Colenso

(10) Patent No.: US 11,002,031 B2
(45) Date of Patent: May 11, 2021

(54) BASE ISOLATION SYSTEM

(71) Applicant: Koroneho Limited, Christchurch (NZ)

(72) Inventor: Nigel Bryan Colenso, Christchurch (NZ)

(73) Assignee: KORONEHO LIMITED, Christchurch (NZ)

( * ) Notice: Subject to any disclaimer, the term of this patent is extended or adjusted under 35 U.S.C. 154(b) by 0 days.

(21) Appl. No.: 16/486,069

(22) PCT Filed: Feb. 16, 2018

(86) PCT No.: PCT/NZ2018/050012
§ 371 (c)(1),
(2) Date: Aug. 14, 2019

(87) PCT Pub. No.: WO2018/151611
PCT Pub. Date: Aug. 23, 2018

(65) Prior Publication Data

US 2020/0002966 A1 Jan. 2, 2020

(30) Foreign Application Priority Data

Feb. 16, 2017 (NZ) ..... 727566

(51) Int. Cl.
*E04H 9/02* (2006.01)

(52) U.S. Cl.
CPC ..... *E04H 9/021* (2013.01); *E04H 9/0235* (2020.05)

(58) Field of Classification Search
CPC ..... E04H 9/021; E04H 9/0235; E04B 1/98
See application file for complete search history.

(56) References Cited

U.S. PATENT DOCUMENTS 3,606,704 A 9/1971 Denton
3,794,277 A * 2/1974 Smedley ..... H02B 1/54 248/548

(Continued)

FOREIGN PATENT DOCUMENTS

BG 51645 7/1993
CN 205502046 8/2016

(Continued)

OTHER PUBLICATIONS

International Preliminary Report on Patentability for PCT/NZ2018/050012 dated May 24, 2018.

(Continued)

*Primary Examiner* — Paola Agudelo
(74) *Attorney, Agent, or Firm* — Christopher M. Scherer; DeWitt LLP

(57) ABSTRACT

Described herein is a base isolation system utilising a pier-like assembly comprising intermediary elements such as pillars isolating a first member and a second member, the second member above the first member and the members in a spaced apart relationship with intermediary elements therebetween. In one aspect, a base isolation system is provided comprising a first member and a second member, the second member being above the first member, the members being in a spaced apart relationship separated by pillars; and wherein each pillar comprises a pillar fixed end and an opposing pillar movable end. In the event of relative movement between the first and second member, the pillars dampen transfer of movement between the members by the movable pillar end moving relative to a movable first or second member thereby reducing the degree of energy transfer between the members. A method of installing a base isolation system is also described herein.

20 Claims, 3 Drawing Sheets

(56) References Cited

U.S. PATENT DOCUMENTS

| | | | | |
|---|---|---|---|---|
| 3,906,689 | A * | 9/1975 | Nakayama | E04H 9/021 52/167.6 |
| 3,921,039 | A * | 11/1975 | Robinson | H02B 1/54 361/830 |
| 4,527,365 | A * | 7/1985 | Yoshizawa | F16F 7/08 267/154 |
| 4,599,834 | A | 7/1986 | Fujimoto et al. | |
| 4,901,486 | A * | 2/1990 | Kobori | E04B 1/98 188/377 |
| 5,363,610 | A * | 11/1994 | Thomas | E04H 9/021 52/167.8 |
| 6,000,670 | A | 12/1999 | Okamoto | |
| 8,291,650 | B2 * | 10/2012 | Vreeland | E04H 9/021 52/167.2 |
| 2007/0261323 | A1 * | 11/2007 | Hubbard | E04B 1/98 52/167.6 |
| 2016/0130805 | A1 | 5/2016 | Ruan et al. | |
| 2018/0266135 | A1 * | 9/2018 | Agha Beigi | E04B 1/98 |

FOREIGN PATENT DOCUMENTS

| | | |
|---|---|---|
| CN | 106639024 | 5/2017 |
| JP | S62141226 | 9/1987 |
| JP | H08303049 | 11/1996 |
| JP | 2000352064 | 12/2000 |
| JP | 2001055842 | 2/2001 |
| JP | 2001303587 | 10/2001 |
| JP | 2002021185 | 1/2002 |
| JP | 2003193487 | 7/2003 |
| JP | 2003261948 | 9/2003 |
| JP | 2004019409 | 1/2004 |
| JP | 2004278157 | 10/2004 |
| JP | 3921549 | 5/2007 |
| JP | 2009121214 | 6/2009 |
| JP | 2009287388 | 12/2009 |
| JP | 2010174580 | 8/2010 |

OTHER PUBLICATIONS

International Search Report and Written Opinion for PCT/NZ2018/050012 dated May 24, 2018.

* cited by examiner

BASE ISOLATION SYSTEM

RELATED APPLICATIONS

This application derives priority from New Zealand patent application number 727566 incorporated herein by reference.

TECHNICAL FIELD

Described herein is a base isolation system. More specifically, a base isolation system is described utilising a pier-like assembly comprising intermediary elements isolating a first member and a second member, the second member above the first member and the members in a spaced apart relationship with intermediary elements there between.

BACKGROUND ART

In the art, various base isolation systems have been manufactured to isolate or dampen movement between two members. Examples include the way a commercial building (a second member) may use rubber pads to absorb seismic energy from ground (first member) movement and therefore lessen the degree of movement imposed on the building. A common theme behind art designs is the separation of the first member e.g. a substrate, from a second member above the first member using an intermediary element that supports the first and second members in a spaced apart relationship yet also dampens or retards energy transfer between the members. Primary dampening or isolation is movement about a horizontal plane. The intermediary element(s) must also accommodate both dynamic (e.g. seismic movement) and non-dynamic movement. Non-dynamic movement may include for example, expansion and contraction caused by ambient temperature changes and/or wind loading on a building.

Reference is made hereafter to use of base isolation systems in building structures to address seismic activity however, as noted above, the same principles may be used in other applications and to address forces other than those generated from seismic activity.

Base isolation systems have become more common in commercial buildings as a means to protect the building and occupants in the even of an earthquake. Earthquakes or seismic activity can generate high acceleration (>0.5 G) dynamic forces in a horizontal plane, a vertical plane, or both horizontal and vertical planes. Besides the movement associated with the earthquake itself, subsequent ground movement can occur such as ground slumping, ground uplift, ground cracking, liquefaction of subsoils, flooding, sometimes many months after the initial earthquake event.

Existing art base isolation systems are typically designed for large steel and concrete commercial buildings in earthquake prone locations typically at least five or more storeys high. These systems are designed to reduce the amount of movement that the commercial building experiences during earthquakes to protect the integrity of the structure, and minimise damage to the building structure, its contents and occupants. They are effective and becoming widely used in commercial buildings however, these systems are costly and not commercially viable for smaller dwellings or structures such as one or two storey dwellings (or paths, bridges, docks and the like). As a result, smaller structures like those listed rarely utilise base isolation technologies and are therefore prone to damage in earthquakes or other ground movement.

It may be useful to provide an alternative base isolation system to help isolate new and/or existing, buildings, not limited to, but including single or two storey lightweight detached buildings, from movements, or at least provide the public with a choice.

Further aspects and advantages of the adjustable base isolation system will become apparent from the ensuing description that is given by way of example only.

SUMMARY

Described herein is a base isolation system utilising a pier-like assembly comprising intermediary elements isolating a first member and a second member, the second member above the first member and the members in a spaced apart relationship with intermediary elements there between.

In a first aspect, there is provided a base isolation system comprising:

- a first member and a second member, the second member being above the first member, the members being in a spaced apart relationship separated by pillars; and wherein each pillar comprises:

- a pillar fixed end and an opposing pillar movable end wherein the pillar fixed end is fixed to a fixed first or second member, and wherein the opposing pillar movable end directly or indirectly bears on a movable first or second member, wherein the first and second members are in alternate fixed or movable relationships relative to the pillar depending on the system arrangement;
- and, in the event of relative movement between the first and second member, the pillars dampen transfer of movement between the members by the movable pillar end moving relative to the movable first or second member thereby reducing the degree of energy transfer between the members.

The inventor has developed a base isolation system akin to that seen in buildings with suspended floors that is financially cost effective even for smaller lower storey buildings unlike art base isolation systems. As should however be appreciated, the same design may also be used for larger structures with scaled up or strengthened parts and reference to smaller structures should not be seen as limiting.

In a second aspect, there is provided a method of installing a base isolation system comprising:

- providing a base isolation system substantially as described above;
- fixing pillars to the first member, the pillars attaching to the first member about a fixed pillar end;
- placing the second member over the pillars about the pillar moveable ends so that the second member or parts thereof directly or indirectly bear on the moveable pillar ends.

Examples of some of the advantages envisaged from the base isolation system described herein are as follows:

- The base isolation system described herein may act to absorb/dampen/retard transfer of a force load between spaced apart members
- It allows for adjustment of the relative positions of the members at installation and after a relative moving force having been applied.
- The system may be designed so that after a force loading event, the system will tend to relocate the members as close as possible back to their original position.
- In a building application, the system is versatile, being able to fix into various types of foundation, optionally cast directly into individual concrete footings, or optionally linked to or integral with piles.

The use of a spaced apart relationship between the members may be beneficial in flood prone locations as the system provides added ground clearance.

The system is highly adjustable both at install and after a movement event potentially in several directions unlike art systems that have minimal if any degree of cost effective adjustment.

The system has a significant life and strength, equivalent to steel assuming steel is used as a primary material for the pillars and biasing members if used.

The system may have the advantage of addressing significant wind events or wind loading as well.

BRIEF DESCRIPTION OF THE DRAWINGS

Further aspects of the base isolation system will become apparent from the following description that is given by way of example only and with reference to the accompanying drawings in which.

DETAILED DESCRIPTION

Figure 1:
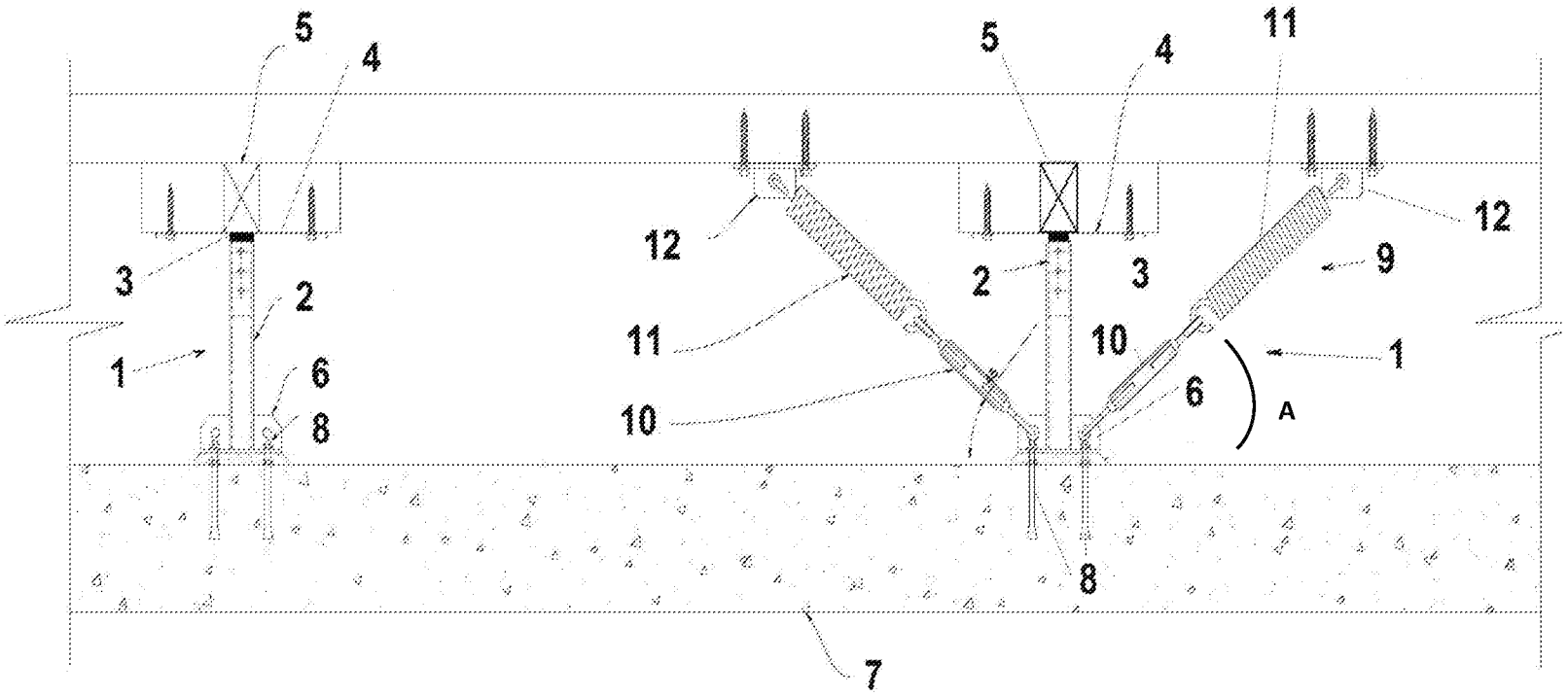
FIG. 1 illustrates a vertical section through a concrete foundation supporting a timber floor structure using one embodiment of the base isolation system as described herein.

As noted above, described herein is a base isolation system utilising a pier-like assembly comprising intermediary elements isolating a first member and a second member, the second member above the first member and the members in a spaced apart relationship with intermediary elements there between.

For the purposes of this specification, the term 'about' or 'approximately' and grammatical variations thereof mean a quantity, level, degree, value, number, frequency, percentage, dimension, size, amount, weight or length that varies by as much as 30, 25, 20, 15, 10, 9, 8, 7, 6, 5, 4, 3, 2, or 1% to a reference quantity, level, degree, value, number, frequency, percentage, dimension, size, amount, weight or length.

The term 'substantially' or grammatical variations thereof refers to at least about 50%, for example 75%, 85%, 95% or 98%.

The term 'comprise' and grammatical variations thereof shall have an inclusive meaning—i.e. that it will be taken to mean an inclusion of not only the listed components it directly references, but also other non-specified components or elements.

The term 'pier' or grammatical variations thereof as used herein refers to a first member and second member in a spaced apart relationship using intermediary elements, the intermediary elements defining an opening between the first and second members. In typical embodiments envisaged, the intermediary elements may be pillars that support a building floor above a foundation substrate such as ground or concrete slab however, as should be appreciated, the same principles may be applied to supporting raised structures such as walkways, decking, sheds, concrete slabs and so on. Synonymous with the term 'pier' as used herein may be the term 'dock' and reference to the term pier may be interchanged with the term dock.

The term 'pillar' or grammatical variations thereof as used herein may be interchangeable with the term 'intermediary element'. For ease of description, the term 'pillar' is generally used herein however this should not be seen as limiting as various intermediary elements may be used besides a generally elongate upright pillar.

The terms 'up', 'down', 'top', 'bottom', 'above', and 'below' and grammatical variations thereof as used herein refer to an alignment as described and are used for ease of description however, the system and parts described could be altered in orientation in a way that these terms may vary, however this should not be seen as limiting since the described alignment of parts is retained. By way of example, the first and second members and intermediary elements/pillars may be assembled with the second member above the first member and the pillars in an upright orientation and the whole system rotated 1-180 degrees yet retaining the original part alignments.

In a first aspect, there is provided a base isolation system comprising:

a first member and a second member, the second member being above the first member, the members being in a spaced apart relationship separated by pillars; and wherein each pillar comprises:

a pillar fixed end and an opposing pillar movable end wherein the pillar fixed end is fixed to a fixed first or second member, and wherein the opposing pillar movable end directly or indirectly bears on a movable first or second member, wherein the first and second members are in alternate fixed or movable relationships relative to the pillar depending on the system arrangement;

and, in the event of relative movement between the first and second member, the pillars dampen transfer of movement between the members by the movable pillar end moving relative to the movable first or second member thereby reducing the degree of energy transfer between the members.

The inventor has developed a base isolation system akin to that seen in buildings with suspended floors that is commercially cost effective even for smaller lower storey buildings unlike art base isolation systems. As should however be appreciated, the same design may also be used for larger structures with scaled up or strengthened parts and reference to smaller structures should not be seen as limiting.

In a second aspect, there is provided a method of installing a base isolation system comprising:

providing a base isolation system substantially as described above;

fixing pillars to the first member, the pillars attaching to the first member about a fixed pillar end;

placing the second member over the pillars about the pillar moveable ends so that the second member or parts thereof directly or indirectly bear on the moveable pillar ends.

Member Orientation

Note that reference is made above to two first or second member configurations relative to the pillar. The first configuration may be where the first member is fixed to the fixed pillar end and the second member moves relative to the movable pillar end. For example, using a building application, the pillar is fixed to a concrete foundation or pile (the first member) and the building floor (the second member) moves relative to the pillar. The second configuration is the opposite scenario with the fixed pillar end being fixed to the second member (e.g. the building floor) and the movable pillar end moving relative to the first member (the concrete foundation or pile). As may be appreciated, both configurations may be possible and reference to one configuration or the other should not be seen as limiting.

The First Member

The first member noted above may be generally planar. In building applications for example, the first member may be a substrate selected from: the ground on which the building is located, a foundation slab or slabs on which the building is to be located, piles (steel or wood for example) on which the building is to be located. As noted above, the first member may also be used in other systems where horizontal plane isolation may be beneficial (or side to side isolation if the system were rotated 90 degrees). For example, the first member could be used a substrate below bridges or suspended paths or decking.

The first member may be generally planar or for example, the pile tops form a generally planar surface. The planar surface may be planar in a generally horizontal orientation. Variations may exist to purely horizontal plane alignment such as minor ground height variations however the system described can be adapted to meet small variations in height (e.g. less than 1500, or 1400, or 1300, or 1200, or 1100, or 1000, or 900, or 800, or 700, or 600, or 500, or 450, or 400, or 350, or 300, or 250, or 200, or 150, or 100, or 50 mm variations). The variations in horizontal plane alignment may be localised or drop or change across the whole or a substantial part of the first member. The above figures are provided by way of example and it may be possible to meet variations in height beyond the limits noted through variations in system scale and part geometry.

The Second Member

The second member may be generally planar. Examples include raised platforms such as: a building floor, a suspended path, a bridge, decking and so on. In building applications for example, the second member may be the building floor on which the building walls and roof are erected. As noted above, the second member may also be used in other systems where horizontal plane isolation may be beneficial (or side to side isolation if the system were rotated 90 degrees). For example the second member could be a bridge, suspended path or decking.

As noted, the second member may be generally planar. The planar surface may be planar in a generally horizontal orientation. Variations may exist to purely horizontal plane alignment such as minor height variations, stepped building floors and so on however, the system described can be adapted to meet small variations in height (e.g. less than 1500, or 1400, or 1300, or 1200, or 1100, or 1000, or 900, or 800, or 700, or 600, or 500, or 450, or 400, or 350, or 300, or 250, or 200, or 150, or 100, or 50 mm variations). The variations in horizontal plane alignment may be localised or drop or change across the whole or a substantial part of the second member. The above figures are provided by way of example and it may be possible to meet variations in height beyond the limits noted through variations in system scale and part geometry.

The Pillar

As defined above, the pillar is an intermediary element between the first and second members. A pillar may for example be a longitudinal element that stands upright, the longitudinal axis being orthogonal to the first and second members.

The pillars may have a cross-section that is circular, square, rectangular or other polygonal form assuming the pillar is solid or hollow. Alternatively, the pillar may have a cross-section formed from various folded shapes such as H-sections, I-beams and so on assuming the pillar is not solid or hollow.

Reference is made hereafter to a hollow round cross section shape or diameter for ease of description however this should not be seen as limiting as other shapes and forms may be used.

The pillars may be manufactured from a structurally acceptable material. The structurally acceptable material may be substantially rigid having properties similar to that observed for metal or composite pillars.

Structurally acceptable materials for example may comprise: steel, metal alloys, aluminium, composite materials, and combinations thereof. The steel may be stainless steel. The stainless steel may be 304 or 316 stainless steel. Alternatively the steel may be mild steel. Where mild steel is used, the mild steel may be protected by hot dip galvanising, nickel-zinc, ZAM or other coating.

The materials noted above may be useful to provide longevity and a working life of 50+ years.

Spacing

As noted above, the pillars described define a spaced relationship between the first and second members. The degree of spacing used may be dependent on the end application for the base isolation system and the structural loading placed on the base isolation system. The spacing may also be varied by choice to increase or decrease the space. By way of example, using a single or two storey dwelling as an example embodiment, the spacing between the substrate e.g. a concrete foundation (first member) and the building floor (second member) may be at least: 200, or 225, or 250, or 275, or 300, or 325, or 350, or 375, or 400, or 425, or 450, or 475, or 500 mm. Evidence compiled by the inventor shows that it may be possible to have a spacing of up to 1.5 m using the current design.

Use of a raised structure like the one described above may be advantageous in flood prone land as the system provides added ground clearance along with base isolation.

Pillar Movement

The moveable end of the pillar may be movable relative to the movable first or second member in at least two dimensions generally about a horizontal plane common with the movable first or second member. Movement may be in any direction within the two dimensions with no constrictions placed on the direction of movement.

Optionally, the extent of movement in any part of the two dimensions noted may be constricted. For example, a stop may be used to define the extent of movement. The stop may form part of a pan that is described further below.

Optionally, pillar movement relative to the movable first or second member could be in a vertical plane.

The pillar movement noted is not reliant and does not use balls or ball bearings, rollers and other moving bearing elements. Instead movement between the elements is a sliding action or slipping action governed substantially by friction between the materials used to form the bearing faces.

Pillar Fixed End

The pillar fixed end may be mounted to the first or second member. Mounting may for example be via a base plate to the member e.g. a foundation slab or pile. In an alternative embodiment, the pillar itself may have an integral base plate that is attached to the fixed first or second member.

The base plate, whether separate or integral may in one example have a flange portion extending about the fixed pillar end that accepts and is retained by fasteners. The base plate may include bracing cleats or eyes, the aim of these features being described further below with reference to the biasing members.

In one embodiment, the base plate may have a substantially flat face that abuts the first or second member e.g. a concrete foundation.

In an alternative embodiment, the base plate is a collar that fits over a pillar and grips about the post fixed end. In this embodiment, the pillar may be a pile and the pile extends from the substrate (first member) to bear on the building floor (second member). In this embodiment, the collar fits over the top of the pile and slides to the exposed pile base adjacent to the substrate, the collar then being tightened about the pile.

In a further alternative embodiment, the base plate may instead be shaped to complement the first or second member shape e.g. the base plate may have a sleeve shape that at least partly fits over a pile. Various base plate shapes may be used to fix the fixed pillar end to the first or second member and these examples should not be seen as limiting.

In one embodiment, packing material such as grout, timber, steel plates and so on may be inserted between the mounting plate/fixed pillar end and the first or second member. Packing may be useful to increase the pillar height and therefore adjust the spacing between the first and second members. The fasteners, if used, may also be adjusted in length to accommodate packing materials.

In the inventor's experience, the height of the pillar may be adjusted by at least 1, or 5, or 10, or 15, or 20, or 25, or 30, or 35, or 40, or 45, or 50, or 55, or 60, or 65, or 70, or 75 mm via this mount/fixed member interface.

The fixed pillar end may be designed to be moment resisting as well. For example the pillar width or shape may resist bending.

Pillar Movable End

As noted above, at the movable end, the pillar end or part thereof may directly or indirectly bear on the movable first or second member. The term 'bear on' refers to the movable pillar end and at least part of the movable first or second member abutting each other. Direct bearing may be the pillar end and at least part of the movable first or second or a part thereof member directly abutting each other. Indirect bearing may be abutment between intermediate parts.

Pillar Fitting

In one embodiment, the movable pillar end may have a pillar fitting attached that bears on the movable first or second or a part thereof.

The pillar fitting may be of predetermined friction that directly or indirectly bears onto the movable first or second member noted above. Where a pan is fitted to the movable first or second member, the pillar fitting may bear on the pan. If a pan is not used, the pillar fitting may bear on the first or second member.

In one embodiment, pillar fitting may have known or predetermined friction properties. The properties referred to may be the coefficient of friction of the material chosen to form the pillar fitting and/or may relate to surfaces features of the pillar fitting that influence the friction/bearing between the pillar fitting and member or pan if used.

The pillar fitting may have a shape that at least partly complements and mates with the movable pillar end or a part thereof.

In one embodiment, the pillar fitting may be plug shaped, the plug portion of the pillar fitting at least partly inserting into the hollow of a movable pillar end. The plug portion may be continuous, for example being a substantially solid or circular cross-section shape with a diameter complementing that of the pillar internal diameter assuming the pillar is hollow.

In an alternative embodiment, the pillar fitting may have a shape that substantially fits over and encloses at least part of the movable pillar end.

In a further embodiment, the pillar fitting shape or at least a plug portion thereof may have a shape that complements a folded section pillar shape to fit over the pillar cross-section. For example, if the pillar were formed from an H-shape beam, the pillar fitting may have a head portion extending to a plug portion and the plug portion may have an opening that describes an H-shape, the opening fitting over the moveable pillar end of the pillar.

In the above embodiments of pillar fitting, the fitting may have a top, the top of the fitting bearing indirectly or directly on the member or pan. The pillar fitting shape where not defined by the pillar itself, may be round, square, triangular or polygonal in cross-section.

The pillar fitting may in one embodiment be manufactured from a plastic. The plastic may in one embodiment be a high density nylon however, other plastics may be used with similar properties, particularly in terms of coefficient of friction and durability. The pillar fitting may be a moulded part.

Pan

As noted above, the movable pillar end may bear on a pan fixed to the bearing face of the movable first or second member.

The term 'pan' as used herein refers to a generally planar material with a main body and outer boundary where the pan ends. The pan body may be relatively thin at less than 5, or 4, or 3, or 2, or 1 mm thick.

The pan outer boundary may define a limit and/or stop to the extent of relative movement of the movable first or second member. The outer boundary may be defined by a lip or turned out face from the pan body that interferes with movable pillar end movement should the pillar move to the extent of the outer boundary. The pan may in one embodiment be at least 200, or 210, or 220, or 230, or 240, or 250, or 260, or 270, or 280, or 290, or 300 mm wide and have a similar depth. The pan size may be at least 3, or 4, or 5, or 6, or 7, or 8, or 9, or 10 times the width and/or depth of the pillar cross-section size/diameter. The pan may have a square or circular shape. It should be appreciated that the above measurements are provided by way of illustration only and larger or smaller dimensions could be used to increase or decrease the extent of pillar end movement allowable relative to the movable first or second member. It may in one embodiment be useful to have a large pan area to minimise the risk of the movable pillar end striking the pan outer boundary and abruptly transferring energy to the movable first or second member. Another embodiment may for example have a steady transition outer boundary shape that such as a graduated curved lip that, in the event of the movable pillar end reaching the lip, gradually transfers any movement to the movable first or second member and therefore avoids risk of abrupt changes yet minimises pan size.

Where the base isolation system is used in a building context and the movable end of the pillar is at the top of the pillar, the pan may be fixed to an underside of a floor, joists or bearers of a supported detached building (the second member).

In one embodiment, the pan may be manufactured from: steel, metal alloys, aluminium, composite materials, and combinations thereof. The steel may be stainless steel. The stainless steel may be 304 or 316 stainless steel. Alternatively the steel may be mild steel. Steels, and particularly stainless steel, may be a useful material for the pan since the surface may be polished or smoothed and retains a smooth finish over time. This smooth surface allows the movable pillar end to slide about the bearing face. Other materials could be used with similar smoothness as stainless steel (mild steel as noted above being one example perhaps with some surface treatment or treatments to achieve a similar smoothness and longevity as stainless steel.

Pillar Fitting Adjustment

As noted above the pillar fitting if used may fit over the moveable end of the pillar. The extent of movement of the fitting relative to the pillar movable end may be adjustable allowing the height of the pillar to be altered as desired by varying the degree of overlap between the fitting and pillar moveable end.

In one embodiment, the fitting and at least part of the pillar movable end may comprise adjustable attachment members or linkages that allow the degree of overlap to be releasably fixed relative to each other. As a result, the combined pillar and pillar fitting height and hence, first and second member spacing may be adjusted.

The attachment members or linkages may for example be formed from retractable pins mounted on the pillar that mate with complementary openings in the pillar fitting. Alternatively, openings may be included in the pillar fitting wall(s) and pillar wall(s) and when the openings overlaps, a fastener may be passed through the openings to lock the pillar fitting and pillar in position.

The overlaps noted above may for example correspond to: 5, or 6, or 7, or 8, or 9, or 10, or 11, or 12, or 13, or 14, or 15, or 16, or 17, or 18, or 19, or 20, or 21, or 22, or 23, or 24, or 25, or 26, or 27, or 28, or 29, or 30, or 31, or 32, or 33, or 34, or 35, or 36, or 37, or 38, or 39, or 40, or 41, or 42, or 43, or 44, or 45, or 46, or 47, or 48, or 49, or 50, or 51, or 52, or 53, or 54, or 55, or 56, or 57, or 58, or 59, or 60, or 61, or 62, or 63, or 64, or 65, or 66, or 67, or 68, or 69, or 70, or 71, or 72, or 73, or 74, or 75 mm height graduations. The height graduations may be at least 5-75 mm each. Multiple linkages may be used along the pillar height thereby determining the height of each graduation. The exact height graduations may depend on the end application, cost and complexity desired but, the above range of graduations are anticipated to provide ample flexibility in building applications. In the inventor's experience, the maximum exposure of the pillar fitting above the movable pillar end may be less than 1.0, or 1.1, or 1.2, or 1.3, or 1.4, or 1.5, or 1.6, or 1.7, or 1.8, or 1.9, or 2.0 times the pillar fitting diameter. In one embodiment, the maximum exposure may be less 1.5 times the pillar fitting diameter.

Pillar height adjustment may be useful on installation of the pillar to address variations in substrate height such as over rough or uneven ground where, for example, the pillars correspond to, or are integrally formed with, building piles. Alternatively, variations in pillar height may be useful to account for varying raised structure profiles such as for stepped suspended pathways or floors (second members).

Pillar height adjustment may also be highly beneficial to address changes in substrate or raised structure slope pillar installation. Examples where adjustment might be required may be where the structure has subsided perhaps due to land subsidence due to flooding or seismicity. In art building methods, there is no raised structure and the structure is built on the substrate. As a result, if the substrate subsides or is raised up, the structure cannot easily be altered in height other than by lifting the entire structure up and re-piling or pouring a new foundation.

Pillar Movement Damping

In the event of relative movement between the movable pillar end and the movable first or second members, the movement may be dampened using at least one biasing member, the biasing member damping or retarding movement between the first and second members.

The at least one biasing member may also act to urge movement of the movable pillar end at least partially back to an original position relative to the movable first or second member after a moving event. Expressed another way, the biasing means may allow the system to self align or self centre so that manual adjustment of pillar position relative to the movable first or second member may not be required or only required to a limited extent during installation or pillar movement of the moveable pillar end.

The biasing member may, on generation of relative movement between the first and second members, cause a biasing force that urges the movable first or second members to return to an initial horizontal plane position relative to the fixed first or second member before generation of relative movement occurred.

The at least one biasing member may, on generation of relative movement between the first and second members, generate a biasing force that urges the movable first or second member towards the fixed first or second member about a vertical plane.

The biasing member or members may cause urging of the first and second members in both horizontal and vertical planes as noted above on generation of relative movement between the first and second members.

The biasing member or members may also provide an urging force or static urging force on the first and second members in horizontal and/or vertical planes as noted above when no movement occurs between the first and second members. This may be useful to create a degree of inertia to movement e.g. to only allow relative movement to occur in M4.0 or greater seismic events yet not allow or limit movement for slow or controlled movement e.g. heat expansion and cooling of materials.

Where a biasing member or members are used, the biasing member(s) may only be used on: 100, or 95, or 90, or 85, or 80, or 75, or 70, or 65, or 60, or 55, or 50, or 45, or 40, or 35, or 30, or 25, or 24, or 23, or 22, or 21, or 20% of the base pillars isolation system. For example, all (100%) of the pillars in the base isolation system may comprise at least one biasing means. Alternatively only half (50%) of the pillars used to form the base isolation system may comprise biasing members. The base isolation system may have approximately 20 to 100% (or all), or 25 to 75%, or 30-70%, or 40 to 60%, or roughly half or 50% of the pillars using at least one biasing member.

Assuming that not all of the pillars have biasing members, the pillars with and without biasing members may be roughly equally spaced apart. For example, if only a third of the pillars use biasing members, and assuming the pillars were spaced apart in a regular square lattice pattern between the first and second members, the biasing member or members may be installed on every third pillar.

In one embodiment, where a pillar utilises biasing members, multiple biasing members may be located on or about the pillar.

Damping Springs

In one embodiment, the biasing member or members may be springs. The springs may be coil springs although other springs types could be used with suitable mechanical redesign. Reference is made hereafter to the use of springs however other biasing members could be used without limitation such as hydraulic rams, or other fluid based rams or damper devices. Note also that the combination of pillar and springs and/or other parts may collectively be termed herein as an assembly or pillar and spring assembly.

Where a pillar incorporates at least one spring and the at least one spring may be fastened at a first spring end to:

- a point along the pillar length; or
- a point about the fixed end of the pillar; or
- a point about the fixed first or second member generally about the fixed end of the pillar; and,
- is fastened at an opposing second spring end to at least part of the moving first or second member.

The spring or springs may be loaded into tension on installation to impose a static force on the system. Assuming four evenly spaced springs are used about a pillar, the tension force on the springs at installation may be approximately 5, or 6, or 7, or 8, or 9, or 10, or 11, or 12, or 13, or 14, or 15 kN in a north/south and east/west direction and a diagonal tension of 8, or 9, or 10, or 11, or 12, or 13, or 14, or 15, or 16, or 17, or 18, or 19, or 20 kN. Expressed another way, the at least one spring may be at least slightly (greater than 1%) elongated elastically when installed. The exact degree of elongation at installation may be varied to suit the design. For example, the spring dynamics such as elasticity, toughness, tensile strength, number of coils, coil size and so on may dictate the degree of elongation used and forces imposed at installation.

The at least one spring dynamics may be chosen so as to avoid plastic deformation and failure on application of designed for force loadings. The at least one spring may be selected so that the maximum force designed for falls within the spring elastic deformation characteristics and avoids any risk of movement into a plastic deformation or fracture zone. This spring characteristic may relate at least in part to the Young's modulus properties of the spring material selected and voids any strain hardening.

Multiple springs may be located about a pillar. The multiple springs may be located equidistant to each other about the pillar circumference/width when viewed from above. Two, or three or four springs may be used, spaced evenly around the pillar circumference/width. Optionally up to eight springs may be used. The size and weight of the building may influence the number of springs used.

The spring at the first spring end may attach to a base plate or mount that the pillar is linked to or integrally formed with at or close to the pillar fixed end e.g. via a bracing cleat or eye in the base plate as noted earlier.

The spring at the second spring end may attach to the moveable first or second member so that the spring or springs are angled relative to the first or second member. Angled attachment may be useful to provide both horizontal and vertical tension from a single spring unlike pure horizontal alignment or pure vertical alignment. Attachment may be via an eye or cleat mounted to the first or second member e.g. the underside of the building floor. The spring angle when viewed in a vertical plane orthogonal to the first or second member generally planar surfaces may be at least: 10, or 15, or 20, or 25, or 30, or 35, or 40, or 45, or 50, or 55, or 60, or 65, or 70, or 75, or 80 degrees relative to the fixed substrate or raised platform. The angle may be 10 to 80 degrees, or 20 to 70 degrees, or 30 to 60 degrees or 40 to 50 degrees. In one embodiment the angle may be approximately 45 degrees relative to the first and second member. Angled inclination may be useful to provide both horizontal and vertical biasing action on the first and second members. Angled inclination may also be useful to address wind loading. By way of example, independent testing of the base isolation system described herein using springs has determined that the system can manage wind loadings of up to 198 km/h, termed Zone 4 under New Zealand regulations.

Tensioning members may further be used to adjust and tension the springs. For example, the tensioning member may be a turnbuckle and the turnbuckle may link to one end of the spring and at the other end to the first or second member or pillar. The tension buckle may then be decreased or increased in length to adjust the tension force applied to the spring.

Adjustment

The term 'adjustment' as stated herein may refer to several different aspects of the design.

As noted above, adjustment may be by altering the height of the space between the substrate and raised structure completed by for example, altering a pillar fitting position relative to a movable pillar end. This in practice allows for vertical plane height adjustment of the raised structure relative to the pillars and substrate.

Vertical height may also be adjusted using adjustable height fasteners, grout packing, steel plate(s) etc located about or between the movable first or second member and pillar movable end/fitting if used.

In addition, vertical height may also be adjusted by altering the fixed pillar end mount e.g. by adding adjustable height fasteners, grout packing, steel plate(s) etc located about or between the fixed first or second member and the mount.

Also as noted above, the pillar movable end can move relative to the movable first or second member. The degree to which movement can occur is something that can be tuned for example, by choice of materials that bear on each other about the movable pillar end and first and second members. For example, choosing materials with a low coefficient of friction would allow more movement than choosing materials with a high coefficient of friction that would tend to bind together more and not slip. The faces of the bearing surfaces could also be formed in different ways to adjust to degree of movement possible and even control or direct the degree and direction of movement. As may be appreciated, this adjustability may be primarily in a horizontal plane.

A further method of adjustment enabled by the base isolation system described is to adjust the degree of biasing member tension or urging force. This may be achieved through different positioning of the biasing member ends relative to the pillar and first or second members however, a further option may be to use tensioning members noted above on the biasing means that may be adjusted as needed at installation or pillar installation. As should be appreciated, different structural loads and substrate characteristics might also require greater or lower biasing member urging forces.

Advantages

Examples of some of the advantages envisaged from the base isolation system described herein are as follows:

- The base isolation system described herein may act to absorb/dampen/retard transfer of a force load between spaced apart members
- It allows for adjustment of the relative positions of the members at installation and pillar a relative moving force having been applied.
- The system may be designed so that after a force loading event, the system will tend to relocate the members as close as possible back to their original position.

In a building application, the system is versatile, being able to fix into various types of foundation, optionally cast directly into individual concrete footings; or optionally linked to or integral with piles.

The use of a spaced apart relationship between the members may be beneficial in flood prone locations as the system provides added ground clearance.

The system is highly adjustable both at install and after a movement event potentially in several directions unlike art systems that have minimal if any degree of cost effective adjustment.

The system has a significant life and strength, equivalent to steel assuming steel is used as a primary material for the pillars and biasing members if used.

The system may have the advantage of addressing significant wind events or wind loading as well.

The embodiments described above may also be said broadly to consist in the parts, elements and features referred to or indicated in the specification of the application, individually or collectively, and any or all combinations of any two or more said parts, elements or features.

Further, where specific integers are mentioned herein which have known equivalents in the art to which the embodiments relate, such known equivalents are deemed to be incorporated herein as of individually set forth.

WORKING EXAMPLES

The above described base isolation system is now described by reference to specific examples.

Reference is made below to the base isolation system being used to mitigate the effects of seismic activity, the first member being a substrate such as the ground or a concrete foundation and, the second member being a raised structure such as a building floor. As noted above, the system may be used for mitigation of other forces and movement and reference to seismic mitigation should not be seen as limiting. Further, reference to the substrate being the ground or a concrete foundation and the raised structure being a building floor should also not be seen as limiting since the substrate may take various forms e.g. piles, a vehicle or vehicle deck, and the raised structure may also take various forms e.g. a suspended pathway, a bridge, a vehicle deck and so on.

Example 1

Figure 3:
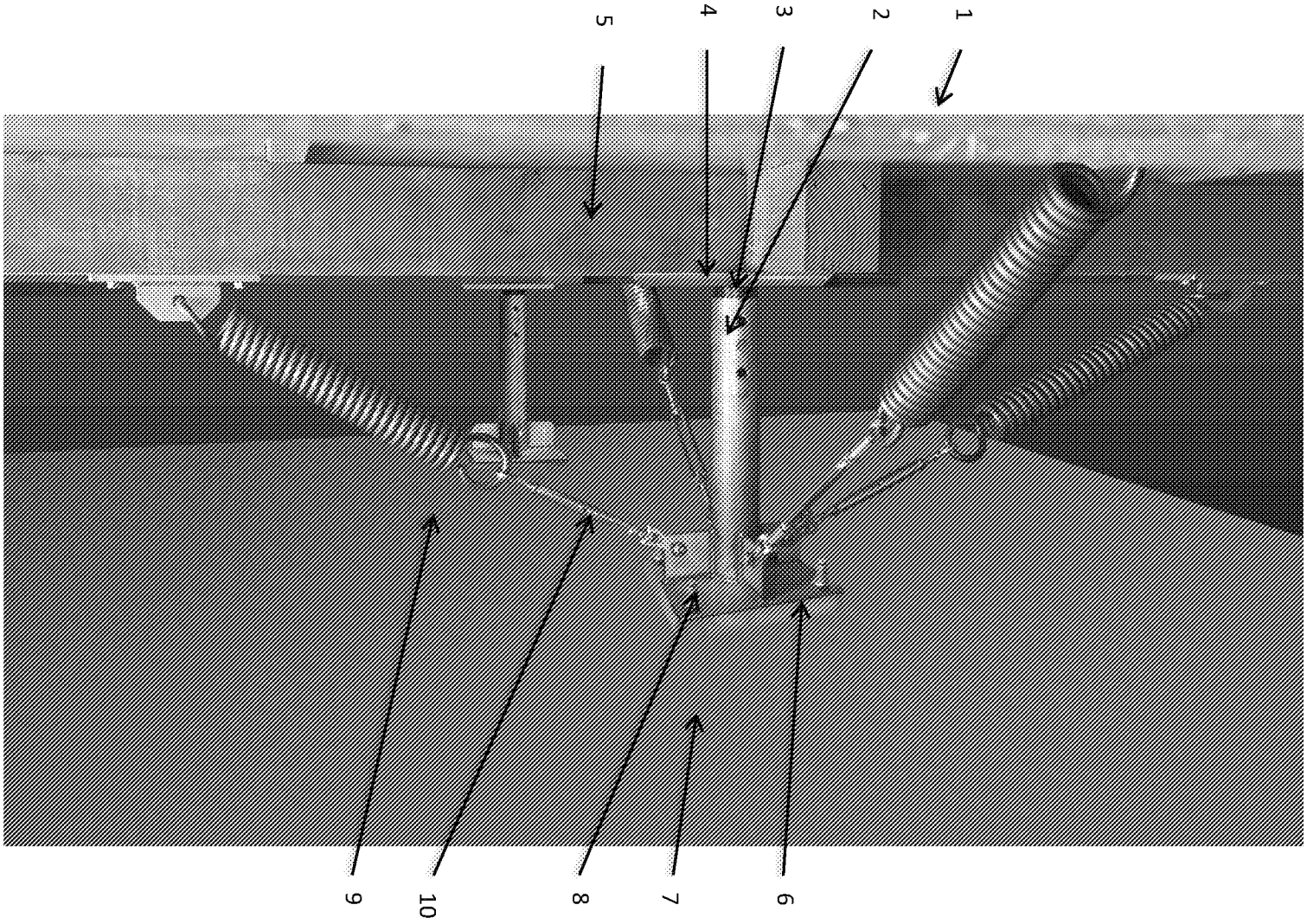
FIG. 3 illustrates a test setup of a pillar and spring assembly used in the base isolation system.

An example embodiment of the base isolation system is shown in FIG. 1 and FIG. 3. The design is easily fitted to existing, new and/or prefabricated buildings. The FIG. 1 and FIG. 3 design deals only with the subfloor structure, leaving the building superstructure design unchanged.

To comply with New Zealand building codes the base isolation system indicated by arrow (1) may be fabricated from a 304 or 316 stainless steel, mild steel, or composite material pillar. Alternatively, a wood or steel foundation pile may form a pillar as described herein. Steel or composites materials may be useful to provide longevity, with a working life of 50+ years.

The base isolation system (1) is adjustable in level, and in height in a number of ways:

A. The top of the pillar (2) of each system (1) has an adjustable height plastic plug insert (3), which bears on a stainless steel pan (4) screwed to the underside of floor, bearers/joists (5). The plastic plug insert (3) may be adjusted vertically in multiple steps with a total vertical adjustment of approximately 75 mm available at the top of each pillar. Maximum exposure of the plastic insert (3) beyond the top (2) of the pier may be no more than 1.5 times the plug insert's (3) diameter;

B. The base plate (6) of each pier (1) is fastened to its foundation (7) by bolts/anchors/threaded rod (8). The two nuts on each bolt (8) above and below the base plate may be individually height adjusted up to 75 mm in small increments;

C. Utilising steps A and B above, an approximate total pier height adjustment of 150 mm may therefore be available;

D. If a pillar is moved out of plumb during or after a seismic event, the base plate nuts (8) can be used to adjust the level, but such level adjustment may reduce the total available height adjustment;

E. The pan (4) may be height adjusted as well by adding/removing packing between pan and floor, bearer/joist (5).

A proportion of the pillars (1) may be attached to a biasing member or members, in this embodiment being a tension spring system indicated by arrow (9). The spring system (9) may be designed to hold the building in approximately its original position during an earthquake, and/or if the building moves, to return it to approximately its original position after the earthquake. If exact post-quake relocation of the building is required, this can be adjusted manually. As shown in FIG. 1 the spring assembly (9) may comprise a turnbuckle (10) attaching the spring (11) to the pillar base plate (6), and a steel cleat or eye-bolt (12) attaching the spring to floor, joist or bearers (5). The springs (11) may be angled relative to the foundation and floor, shown in FIG. 1 as angle A, in the example being approximately 45 degrees relative to the foundation and building floor although other angles may be used. The angled nature of the springs may be useful to provide both horizontal and vertical tension forces on the base isolation system about the pillar (2).

Alternatively, (not shown), the pillar (1) can be cast into individual concrete footings. Due to casting in, the pillar height can only be adjusted by its plastic plug (3) after a quake, but not height adjusted or re-levelled at its base plate (8).

In a further alternative embodiment (not shown), the system (1) may be flipped over with the pillar fixed to the building floor at the top of the pillar and the plastic plug/pan interface at the bottom of the pillar.

Figure 2:
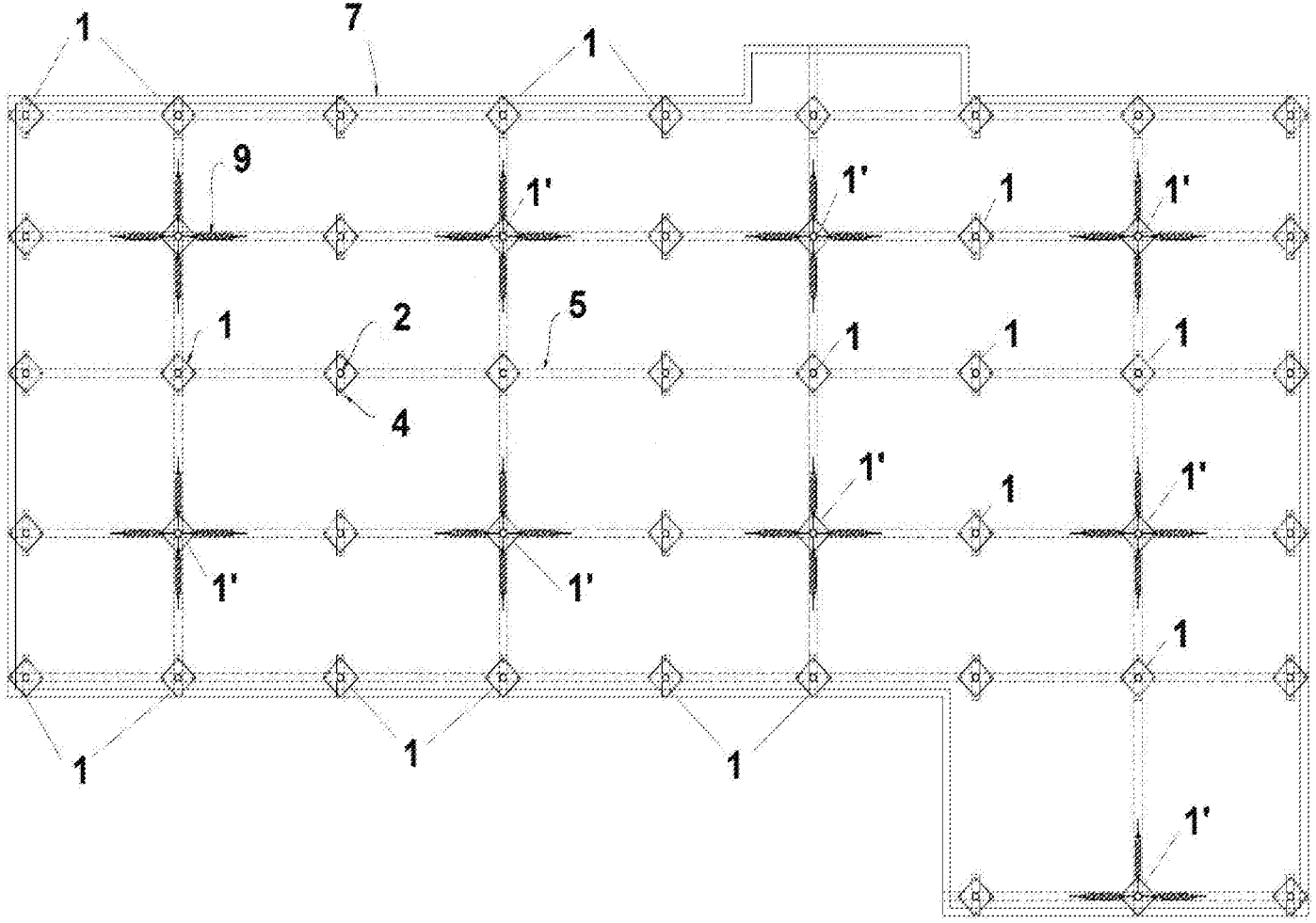
FIG. 2 illustrates an example floor plan of a house and an example layout of the base isolation system designed to isolate the timber floor structure from its foundation.

The illustration of FIG. 2 shows the adjustable tension spring system (9) when attached to only a proportion of the pillars under a building. The exact number of pillars and springs required in each new installation may be calculated by a Structural Engineer but, as shown, need not be at every pillar located under a raised structure or building floor.

Example 2

A sample base isolation (1) was independently tested in New Zealand, and worked as designed. The spring assemblies (9) had a North/South and East/West tension of 9 kN, and a diagonal tension of 13 kN.

The base of the pillar in the pier system was designed to be moment-resisting. Both square (SHS) and circular (CHS) hollow section steel pillars (2) were found to be acceptable.

High density nylon may be used to form the plugs (3) or at least the bearing faces of the plugs (3), the plugs (3) being inserted into the top of each pillar (2). During an earthquake event, the plugs are designed to slide within the stainless steel pans (4) attached to the underside of floors, bearers/joists (5). The free height of this nylon plug (3) is as noted above, adjustable, to allow for post-quake re-levelling. However, to minimise bending stresses within the nylon plug (3), the free height may be limited to 1.5 times the plug diameter.

When the building is impacted by seismic forces, friction between the nylon plug (3) on the stainless steel pan (4) may reduce the likelihood of uncontrolled oscillation/dampen relative movement. Too little friction means oscillation will take time to dissipate. Too much friction will make the assembly ineffective in absorbing seismic energy.

In order for the springs (9) to optimally absorb energy during seismic shaking, the spring assembly may be installed at an angle of 10-80, or 10-70, or 10-60, or 10-50 or not more than 45 degrees from horizontal. In FIG. 1, the system is shown with the springs at a 45 degree angle relative to the foundation (7).

The assembly (9) may consist of 304 or 316 stainless steel (or similar property material) coil tension springs (11), which may be attached at the top end via steel brackets/eye-bolts (12) to the building sub-floor, and at the bottom end to turnbuckles (10).

Turnbuckles (10) may be useful to adjust the length/tension of the springs and may have a tensile capacity of at least 13 kN although this tensile capacity may be varied depending on the load and application for the base isolation system.

Where the upper end of the spring assembly (9) is connected to floor joists (5), the floor joists (5) above the pillar (2) and where spring assemblies (9) are connected, may be doubled up or reinforced.

Directly above each pillar (2) with its plastic plug insert (3), a stainless steel pan (4) is attached to the underside of the floor/bearer on which the plug (3) can slide. The pan (4) may have raised sides to prevent the plug from sliding off the pan area when moving. To minimise friction, the surface of the stainless steel pan (4) may be smooth. It is envisaged that a system (1) may be designed so that the lateral movement of the pillars (2) is no more than 120 mm in any direction from the pillar's central location, or 240 mm in total. Increasing the size of the pan (4) could allow for greater lateral movement if desired.

Example 3

A representative specimen comprising the base isolation system pillars, springs, bearers, joists and weighted flooring was tested in New Zealand by an independent testing laboratory.

Testing was carried out to determine if the base isolation system and its components would work as designed and to determine how the stiffness of the springs and other components behaved under cyclic loading. In the test setup the loads were applied to the superstructure so that it slid on the nylon plugs.

The test observation and results indicated that the base isolation system behaved as expected. Testing also determined that:

a. Due to friction, the structure does not always return exactly to its original location on the piers;

b. The springs were more effective at returning the structure to its original position when pre-tensioned during installation by about 50 mm. During the design earthquake the total estimated lateral load experienced by the sample building without base isolation was 136.90 KN. The pier design includes spring assemblies (9). It was assumed that each of these assemblies (9) will equally share the lateral load which is equivalent to the design earthquake load less the static friction between the nylon plugs (3) and the stainless steel pans (4), or approximately 10.91 kN per assembly. In each assembly, each spring (11) is designed for a 10.91 kN lateral load. At 45 degree inclination, this equates to 15.43 kN in tension. Each spring (11) is sized using this tensile force.

The frictional force between the superstructure and the subfloor system is a function of the total weight of the building and the coefficient of friction between the nylon plugs and the stainless steel pans. In order for the pier system to start sliding, this force must be overcome. The total seismic load from the superstructure in the sample building was computed to be 292.47 kN. Using 0.19 coefficient of static friction (result of above physical testing) between the stainless steel pan (4) and the nylon plug (3), the total friction to be overcome is 55.45 kN or 1.16 kN per pillar (48 pillars). Once this is overcome by the seismic force, the spring assemblies (9) stretch and move the superstructure back towards its original position.

Due to friction, the superstructure may not always slide back exactly to an original position. If the eccentricity created is excessive after a major earthquake, it might be desirable to manually slightly manoeuvre the superstructure back to its original position. Due to nature of the design, this is a relatively simple action to take unlike art methods where this is not commercially practical.

In smaller earthquakes where seismic loads generated are not sufficient to overcome the friction in the pier system, 100% of seismic loads will be transmitted to the building superstructure. In larger earthquakes, 55.45 kN (equivalent to friction) of seismic force will initially be transmitted to the building, but as the pier system starts to move against the superstructure, the additional seismic loads will be absorbed by the spring assembly and forces dampened.

The trial completed was done for a single storey detached building constructed of lightweight materials. Calculations show that the system may be applied also to two-storey detached lightweight buildings subject to specific design.

The design tested was based on a minimum crawl space under the house of 450 mm per NZ Building Code/MBIE guidelines. This crawl space may be varied which may also alter the structural requirements of the design.

The system can be retro-fitted to existing buildings by jacking up the building, excavating/pouring a concrete slab foundation or footing(s)/piles, or some other approved foundation/footing device, fixing the piers to the foundation/footings/piles, fixing stainless steel pans and spring cleats to the underside of the building, lowering the building onto the piers, and connecting/tensioning the springs.

Aspects of the base isolation system have been described by way of example only and it should be appreciated that modifications and additions may be made thereto without departing from the scope of the claims herein.

What is claimed is:

1. A base isolation system comprising:

a first member and a second member, the second member being above the first member, the members being in a spaced apart relationship separated by pillars each pillar attached at either pillar end to the first and second member; and wherein each pillar comprises:

a pillar fixed end linked to the first member and an opposing pillar movable end that indirectly bears on the second member via a pan and plastic plug;

and, in the event of relative movement between the first and second member, the pillars dampen transfer of movement between the first and second members by the movable pillar end moving relative to the second member thereby reducing the degree of energy transfer between the first and second members; and wherein the base isolation system comprises at least one spring and the at least one spring is fastened at a first spring end to: a point about the fixed end of the pillar; or a point about the first member about the pillar fixed end; and, is fastened at an opposing second spring end to at least part of the second member and the at least one spring is attached in an alignment where the at least one spring is angled relative to the first or second member.

2. The base isolation system as claimed in claim 1 wherein the first and second members are generally planar.

3. The base isolation system as claimed in claim 1 wherein the spacing between the first and second members is at least 200 mm.

4. The base isolation system as claimed in claim 1 wherein the moveable pillar end moves relative to the second member in at least two dimensions generally about a common horizontal plane.

5. The base isolation system as claimed in claim 1 wherein the plastic plug height is adjustable allowing the height of the spacing between the first and second members to be altered.

6. The base isolation system as claimed in claim 1 wherein the pan has an outer boundary lip that defines a limit to the extent of relative movement of the second member relative to the movable pillar end.

7. The base isolation system as claimed in claim 1 wherein the biasing member or members cause urging of the second members in a horizontal plane, a vertical plane, or both horizontal and vertical planes.

8. The base isolation system as claimed in claim 1 wherein the biasing member or members are used on 20% to 80100% of the base isolation system pillars.

9. The base isolation system as claimed in claim 1 wherein the angle of the at least one spring relative to the first or second member is not more than 45 degrees.

10. A method of installing a base isolation system comprising:

providing a base isolation system as claimed in claim 1;

fixing pillars to the first member, the pillars attaching to the first member about a fixed pillar end;

placing the second member over the pillars about the pillar moveable ends so that the second member or parts thereof directly or indirectly bear on the moveable pillar ends.

11. A base isolation system comprising:

a first member and a second member, the second member being above the first member, the members being in a spaced apart relationship separated by pillars each pillar attached at either pillar end to the first and second member; and wherein each pillar comprises:

a pillar fixed end linked to the first member and an opposing pillar movable end that indirectly bears on a movable second member via a pan and plastic plug;

and, in the event of relative movement between the first and second member, the pillars dampen transfer of movement between the first and second members by the movable pillar end moving relative to the second member thereby reducing the degree of energy transfer between the first and second members;

wherein the pillar fixed end is mounted to the first member via a base plate the base plate located between the pillar fixed end and the first member and wherein the base plate is mounted at a variable height relative to the first member so as to adjust the pillar height.

12. The base isolation system as claimed in claim 11 wherein the first and second members are generally planar.

13. The base isolation system as claimed in claim 11 wherein the spacing between the first and second members is at least 200 mm.

14. The base isolation system as claimed in claim 11 wherein the plastic plug height is adjustable allowing the height of the spacing between the first and second members to be altered.

15. The base isolation system as claimed in claim 11 wherein the base isolation system comprises at least one spring and the at least one spring is fastened at a first spring end to: a point about the fixed end of the pillar; or a point about the first member about the pillar fixed end; and, is fastened at an opposing second spring end to at least part of the second member and the at least one spring is attached in an alignment where the at least one spring is angled relative to the first or second member.

16. A base isolation system comprising:

a first member and a second member, the second member being above the first member, the members being in a spaced apart relationship separated by pillars each pillar attached at either pillar end to the first and second member; and wherein each pillar comprises:

a pillar fixed end linked to the first member and an opposing pillar movable end that indirectly bears on a movable second member via a pan and plastic plug;

and, in the event of relative movement between the first and second member, the pillars dampen transfer of movement between the first and second members by the movable pillar end moving relative to the second member thereby reducing the degree of energy transfer between the first and second members;

wherein the system further comprises at least one biasing member, the biasing member damping or retarding movement between first and second members and wherein the at least one biasing member acts to urge movement of the pillar movable end at least partially back to an original position relative to the second member after a moving event; and wherein the at least one biasing member is at least one spring and the at least one spring is fastened at a second spring end to the second member at a point distant to the pan.

17. The base isolation system as claimed in claim 16 wherein the first and second members are generally planar.

18. The base isolation system as claimed in claim 16 wherein the spacing between the first and second members is at least 200 mm.

19. The base isolation system as claimed in claim 16 wherein the biasing member or members cause urging of the second members in a horizontal plane, a vertical plane, or both horizontal and vertical planes.

20. The base isolation system as claimed in claim 16 wherein the biasing member or members are used on 20 to 100% of the base isolation system pillars.

* * * * *